US010476150B2

(12) United States Patent
Toyao et al.

(10) Patent No.: US 10,476,150 B2
(45) Date of Patent: Nov. 12, 2019

(54) WIRELESS COMMUNICATION DEVICE

(71) Applicant: NEC CORPORATION, Tokyo (JP)

(72) Inventors: Hiroshi Toyao, Tokyo (JP); Keishi Kosaka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/741,892

(22) PCT Filed: Jul. 6, 2016

(86) PCT No.: PCT/JP2016/070003
§ 371 (c)(1),
(2) Date: Jan. 4, 2018

(87) PCT Pub. No.: WO2017/006959
PCT Pub. Date: Jan. 12, 2017

(65) Prior Publication Data

US 2018/0198197 A1 Jul. 12, 2018

(30) Foreign Application Priority Data

Jul. 8, 2015 (JP) ..... 2015-137069
Feb. 22, 2016 (JP) ..... 2016-030736

(51) Int. Cl.
*H01Q 1/42* (2006.01)
*H01Q 1/44* (2006.01)
(Continued)

(52) U.S. Cl.
CPC ..... *H01Q 1/422* (2013.01); *H01Q 1/42* (2013.01); *H01Q 1/44* (2013.01); *H01Q 19/10* (2013.01);
(Continued)

(58) Field of Classification Search
CPC ..... H01Q 1/422; H01Q 9/19; H01Q 21/24; H01Q 1/42; H01Q 1/44; H01Q 21/06; H01Q 19/10
See application file for complete search history.

(56) References Cited

U.S. PATENT DOCUMENTS 4,749,997 A * 6/1988 Canonico ..... H01Q 1/287 343/705
2011/0057852 A1* 3/2011 Holland ..... H01Q 9/28 343/795
(Continued)

FOREIGN PATENT DOCUMENTS

JP 47-28845 A 11/1972
JP 2010-503356 A 1/2010
(Continued)

OTHER PUBLICATIONS

Written Opinion for PCT/JP2016/070003, dated Aug. 2, 2016.
International Search Report for PCT/JP2016/070003, dated Aug. 2, 2016.

*Primary Examiner* — Dieu Hien T Duong
(74) *Attorney, Agent, or Firm* — Sughrue Mion, PLLC

(57) ABSTRACT

A wireless communication device includes a reflecting plate having a reflecting surface that reflects electromagnetic wave, a radome covering the reflecting plate so as to form an airflow path between the radome and the reflecting surface, and including an air inlet and an air outlet communicating with the airflow path, an array antenna provided on the reflecting surface and inside the airflow path, and including a plurality of antenna elements aligned on the reflecting surface with an interval from each other, and a communication circuit that transmits and receives a wireless signal by exciting the array antenna. The plurality of antenna elements each include an antenna pattern formed on a plate-shaped dielectric substrate extending from the reflecting surface in
(Continued)

a direction orthogonal thereto. Dissipation effect of heat from the communication circuit can be improved, by causing air convection in the airflow path in the radome.

10 Claims, 16 Drawing Sheets

(51) Int. Cl.
*H01Q 19/10* (2006.01)
*H01Q 21/06* (2006.01)
*H01Q 21/24* (2006.01)

(52) U.S. Cl.
CPC ..... *H01Q 19/108* (2013.01); *H01Q 21/06* (2013.01); *H01Q 21/062* (2013.01); *H01Q 21/24* (2013.01)

(56) References Cited

U.S. PATENT DOCUMENTS

| | | | |
|---|---|---|---|
| 2011/0175782 | A1 | 7/2011 | Choi et al. |
| 2013/0222201 | A1 | 8/2013 | Ma et al. |

FOREIGN PATENT DOCUMENTS

| | | | | |
|---|---|---|---|---|
| JP | 2012-503405 | A | | 2/2012 |
| JP | 2012-156943 | A | | 8/2012 |
| JP | 2012-161035 | A | | 8/2012 |
| JP | 2012161035 | A | * | 8/2012 |
| JP | 2013-031074 | A | | 2/2013 |
| JP | 2013-197664 | A | | 9/2013 |
| JP | 2014-082701 | A | | 5/2014 |

* cited by examiner

WIRELESS COMMUNICATION DEVICE

CROSS REFERENCE TO RELATED APPLICATIONS

This application is a National Stage of International Application No. PCT/JP2016/070003 filed Jul. 6, 2016, claiming priority based on Japanese Patent Application No. 2015-137069 filed Jul. 8, 2015 and Japanese Patent Application No. 2016-030736 filed Feb. 22, 2016, the contents of all of which are incorporated herein by reference in their entirety.

TECHNICAL FIELD

The present invention relates to a wireless communication device including a communication circuit that transmits and receives wireless signals through a plurality of antennas.

This application claims priority based on Japanese Patent Application No. 2015-137069 filed on Jul. 8, 2015 and Japanese Patent Application No. 2016-30736 filed on Feb. 22, 2016, the entire content of which is incorporated hereinto by reference.

BACKGROUND ART

Along with the recent progress in network technology, the number of mobile terminal devices, as well as the base stations, have increased, resulting in a sharp increase in volume of wireless communication transmitted and received on the network. Accordingly, a multiple input multiple output (MIMO) communication method, in which a plurality of antennas are utilized at the same time, and beam forming with an antenna array including a plurality of antenna elements aligned with an interval between each other, have come to be adopted in the wireless communication device. Further, the number of antennas incorporated in the wireless communication devices of the mobile communication base stations is increasing, and also the number of communication circuits and baseband circuits connected to the antenna is increasing. Because of such increase in number of antennas and in number of circuits, the wireless communication devices have come to generate a larger amount of heat, which leads to an increase in size of radiators and heat exchangers for cooling the antenna and the circuit.

Antenna devices including a plurality of antennas, as well as antenna devices configured to dissipate heat, have conventionally been developed. Patent Literature (PTL) 1 discloses an active antenna system wireless module including an antenna reflecting plate having a heatsink. PTL 2 discloses an antenna device for a mobile communication system base station, in which a circuit substrate having electronic parts mounted thereon, antenna elements, and a reflecting plate are provided in a radome, with a structure that efficiently emits heat from the electronic parts to outside the radome. PTL 3 discloses an antenna including a reflecting plate and a radiator element, the radiator element having an array structure including a plurality of pairs of dipole antenna elements. PTL 4 discloses an antenna device in which electronic parts are mounted inside an elongate cover having a plurality of vent holes, to prevent an excessive increase of the temperature of the cover. PTL 5 discloses a dual-frequency dual-polarization antenna for a mobile communication base station, including a first radiator element module for a first frequency band and a second radiator element module for a second frequency band, the second radiator element module including a plurality of cross-shaped dipoles.

CITATION LIST

Patent Literature

[PTL 1] US Patent Application Publication No. 2013/0222201

[PTL 2] Unexamined Japanese Patent Application Laid-Open No. 2014-82701

[PTL 3] Unexamined Japanese Patent Application Laid-Open No. 2013-197664

[PTL 4] Unexamined Japanese Patent Application Laid-Open No. 2013-31074

[PTL 5] Unexamined Japanese Patent Application (Translation of PCT Application) Publication No. 2010-503356

SUMMARY OF THE INVENTION

Technical Problem

As mentioned above, PTL 1 discloses the wireless communication device built in a reduced size by unifying a radiator and the reflecting plate of the antenna thereby improving heat dissipation performance per volume. In this wireless communication device, a relatively large reflecting plate made of a metal is utilized as heat dissipation path, and radiator fins are attached to the rear face of the reflecting plate, to reduce thermal resistance. According to PTL 1, the mentioned configuration improves the heat dissipation performance, without incurring an increase in size of the wireless communication device.

In the wireless communication device according to PTL 1, the radiator fins attached to the rear face of the reflecting plate play an important role for the heat dissipation. Therefore, in the case where the wireless communication device is mounted on a wall face or a column, a major part of the radiator fins is covered with the wall face or column, which impedes sufficient supply of air to contact the radiator fin, thereby limiting the heat dissipation performance.

The present invention has been accomplished in view of the foregoing problem, and provides a wireless communication device configured to improve heat dissipation performance, without incurring an increase in size of a structure including a plurality of antennas.

Solution to Problem

In an aspect, the present invention provides a wireless communication device including a reflecting plate having a reflecting surface that reflects electromagnetic wave, a radome covering the reflecting plate so as to form an airflow path between the radome and the reflecting surface, and including an air inlet and an air outlet communicating with the airflow path, an array antenna provided on the reflecting surface and inside the airflow path, and including a plurality of antenna elements aligned on the reflecting surface with an interval from each other, and a communication circuit that transmits and receives a wireless signal by exciting the array antenna. The plurality of antenna elements each include an antenna pattern formed on a plate-shaped dielectric substrate extending from the reflecting surface in a direction orthogonal thereto.

Advantageous Effects of the Invention

The mentioned configuration allows the plurality of antenna elements to be aligned without incurring an increase in size of the wireless communication device, and also facilitates convection of air in the airflow path inside the radome, to thereby improve dissipation effect of heat generated in the communication circuit.

DESCRIPTION OF EMBODIMENTS

Hereafter, a wireless communication device according to the present invention will be described in detail, with reference to examples and accompanying drawings.

Example 1

Figure 1:
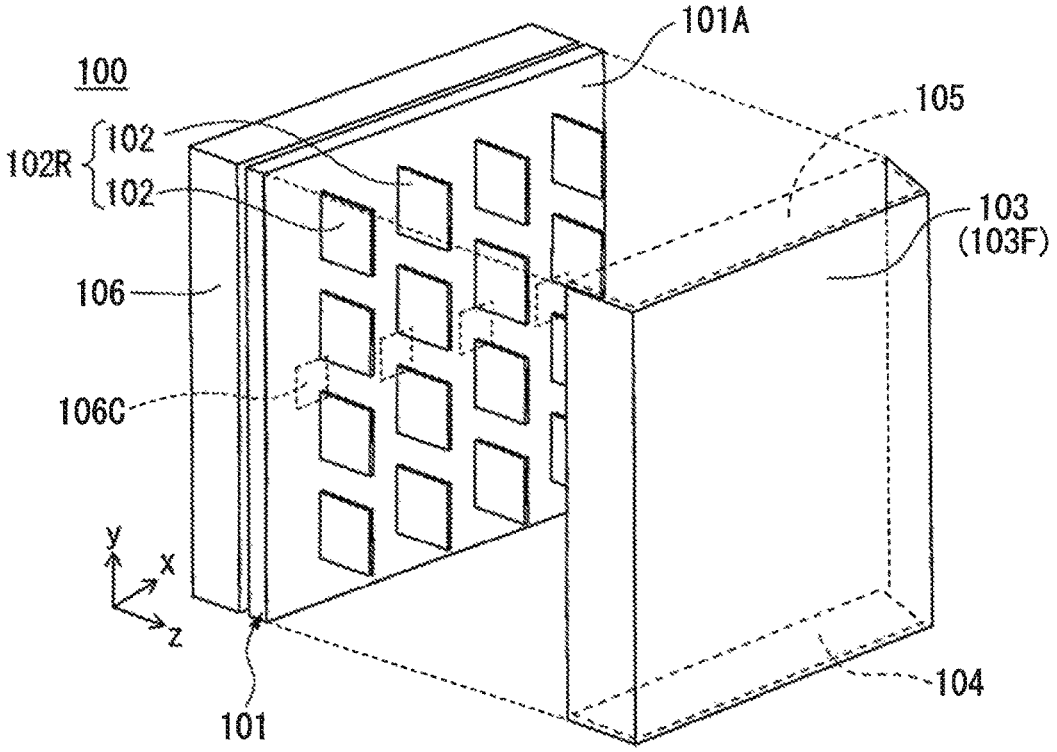
FIG. 1 is a perspective view showing a wireless communication device according to an example 1 of the present invention.

FIG. 1 is a perspective view showing a wireless communication device 100 according to an example 1 of the present invention. The wireless communication device 100 includes a box-shaped casing 106, a reflecting plate 101 integrally attached to the casing 106, an array antenna 102R including a plurality of antenna elements 102 provided on the reflecting plate 101, and a radar dome (hereinafter, radome) 103 covering the array antenna 102R. The radome 103 includes an air inlet 104 and an air outlet 105, formed in an upper and a lower end portion, respectively.

The casing 106 accommodates therein a communication circuit 106C. The communication circuit 106C is electrically connected to the array antenna 102R. Accordingly, a wireless signal generated in the communication circuit 106C is emitted into atmospheric air through the array antenna 102R as electromagnetic wave, for transmission and reception to and from other apparatuses (e.g., wireless terminal device). The communication circuit 106C is connected to the reflecting plate 101 via a component having high thermal conductivity, so that a part of generated heat is conducted to the reflecting plate 101.

The reflecting plate 101 is a plate-shaped member formed of a conductive material. One of the surfaces of the reflecting plate 101 serves as a reflecting surface 101A that reflects electromagnetic wave. The reflecting plate 101 is disposed such that the reflecting surface 101A is oriented in a direction intersecting a vertical direction (i.e., horizontal direction). In the description given hereunder, directions orthogonal to each other in a plane corresponding to the reflecting surface 101A will be defined as an x-axis direction and a y-axis direction. In addition, a direction of the normal of the xy-plane formed in the x-axis and y-axis directions will be defined as a z-axis direction. Further, a positive side in the y-axis direction will be defined as a vertically upper side, and a negative side in the y-axis direction will be defined as a vertically lower side.

Figure 2:
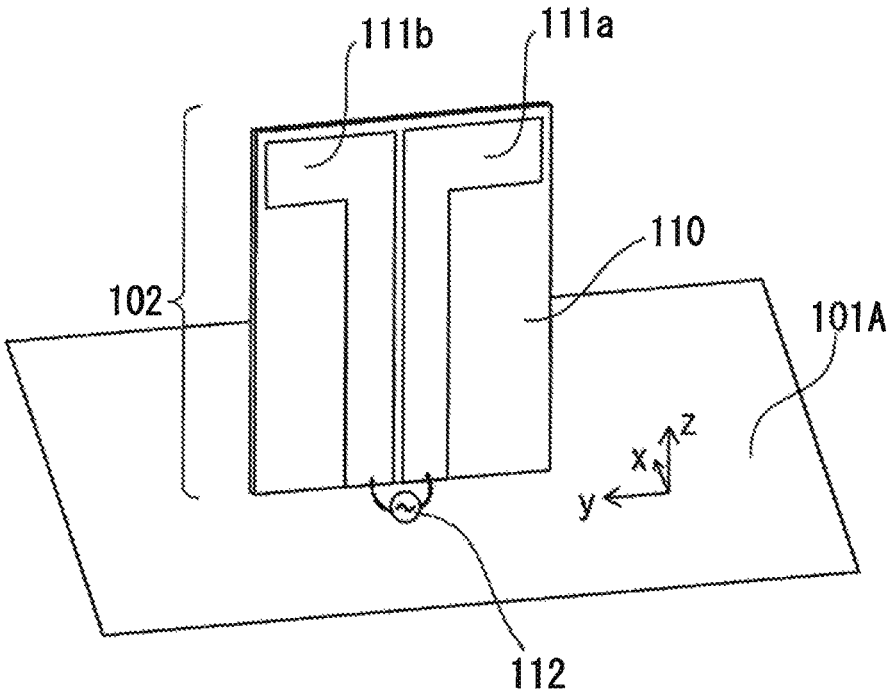
FIG. 2 is a perspective view showing an antenna element provided on a reflecting plate in the wireless communication device.

A plurality of antenna elements 102 are aligned on the reflecting surface 101A of the reflecting plate 101, with an interval from each other. FIG. 2 is a perspective view showing the antenna elements provided on the reflecting surface 101A of the reflecting plate 101. As shown in FIG. 1 and FIG. 2, the antenna elements 102 each have a plate shape, and extend in a generally perpendicular direction (z-axis direction) with respect to the reflecting surface 101A. In the wireless communication device 100 according to the example 1, the plurality of antenna elements 102 are aligned in a grid pattern when viewed from the normal direction of the reflecting surface 101A (z-axis direction). Both surfaces of each of the antenna elements 102 in the thickness direction are oriented in the x-axis direction.

As shown in FIG. 2, each of the antenna element 102 includes a plate-shaped dielectric substrate 110, and antenna patterns 111*a*, 111*b* which are conductor patterns formed on the surface of the dielectric substrate 110. The dielectric substrate 110 is located such that the surfaces thereof in the thickness direction are oriented in the x-axis direction. The dielectric substrate 110 is constituted of, for example, a printed circuit board formed of a glass epoxy resin, or a ceramic substrate formed of low-temperature co-fired ceramic (LTCC).

In the wireless communication device 100, a pair of generally L-shaped printed circuit boards are provided on one of the surfaces of the dielectric substrate 101 on the antenna element 102. It is preferable to employ a material having high electric conductivity and high thermal conductivity, such as copper foil, to form the printed circuit board. Thus, the pair of L-shaped printed circuit boards correspond to the pair of antenna patterns 111*a*, 111*b*.

The antenna patterns 111*a*, 111*b* are connected to the communication circuit 106C located inside the casing 106, via a feed point 112. Thus, the wireless signal generated in the communication circuit 106C is provided to the antenna patterns 111*a*, 111*b* via the feed point 112, to excite the antenna patterns 111*a*, 111*b*. Since the antenna patterns 111*a*, 111*b* are oriented in the x-axis direction in each of the antenna element 102 as stated above, a dipole antenna is formed so as to transmit and receive the electromagnetic wave polarized in the y-axis direction (i.e., vertical direction).

In the wireless communication device 100, the plurality of antenna elements 102 are aligned on the reflecting surface 101A, thereby forming an array antenna 102R. Therefore, a beam proceeding in a specific direction can be formed, by varying the signal phase and power with respect to each of the antenna elements 102.

As shown in FIG. 1, the radome 103 covers the reflecting plate 101 on the side of the reflecting surface 101A. More specifically, the radome 103 is bent generally in a C shape, when viewed in the y-axis direction. The edges of the radome 103 in the x-axis direction are respectively fixed to the sides of the casing 106 extending in the y-axis direction. When the radome 103 is thus fixed to the casing 106, a space that serves as an airflow path 103F is defined between the radome 103 and the reflecting surface 101A. In this space, the plurality of antenna elements 102 provided on the reflecting surface 101A are accommodated.

The upper and lower ends of the airflow path 103F in the y-axis direction are open to outside. In the airflow path 103F, the opening oriented to the vertically lower side (y-axis negative direction) corresponds to the air inlet 104, and the opening oriented to the vertically upper side (y-axis positive direction) corresponds to the air outlet 105. Thus, the airflow path 103F communicates with outside via the air inlet 104 and the air outlet 105. Here, it is preferable to employ an insulative material to form the radome 103, to prevent the signal emitted from the antenna element 102 from being blocked.

Figure 3A:
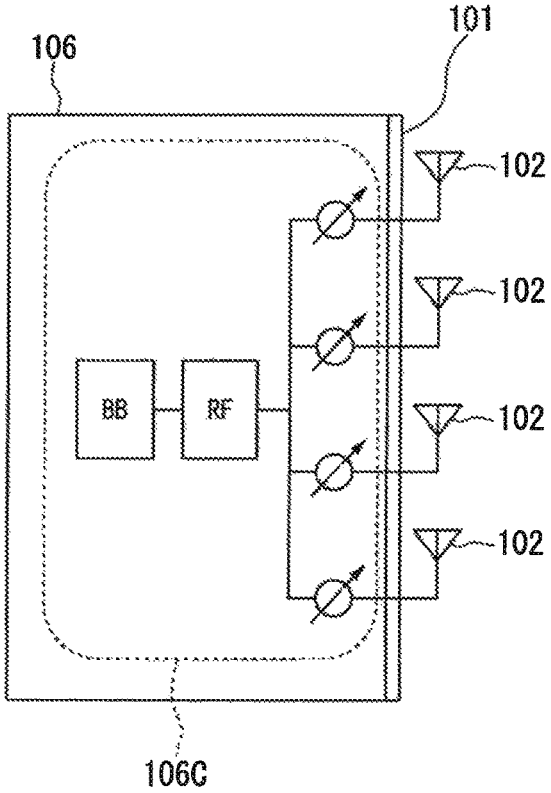
FIG. 3A is a block diagram showing an example of a configuration of a wireless circuit connected to a plurality of antenna elements.

Hereunder, a circuit configuration of the communication circuit 106C will be described. FIG. 3A is a block diagram showing an example of the configuration of the communication circuit 106C. As shown in FIG. 3A, the communication circuit 106C includes a baseband circuit (BB), a wireless circuit (RF), and phase shifters. Further, the communication circuit 106 C has a phase shifter for each antenna element 102 one by one. Accordingly, the communication circuit 106C can shift the phase with respect to each of the antenna elements 102, and can therefore control the beam direction.

Figure 3B:
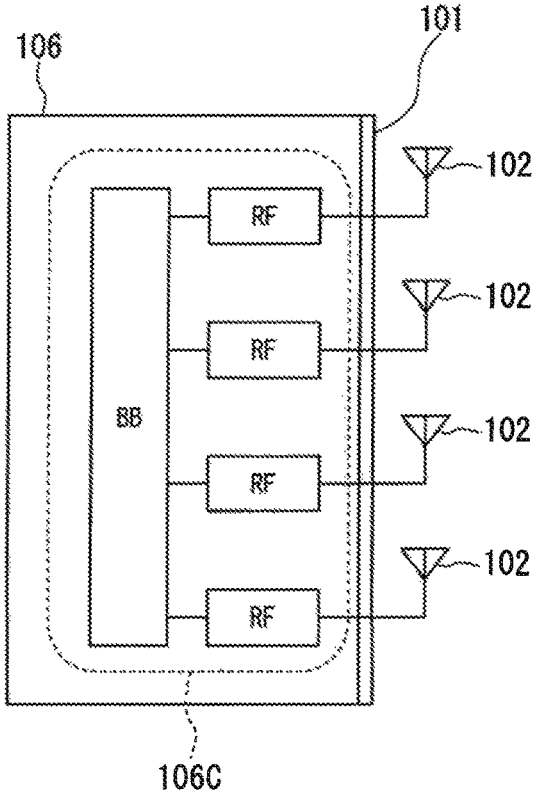
FIG. 3B is a block diagram showing another example of the configuration of a wireless circuit connected to the plurality of antenna elements.

FIG. 3B is a block diagram showing another example of the configuration of the communication circuit 106C. In FIG. 3B, the communication circuit 106C includes a baseband circuit (BB) and wireless circuits (RF) respectively corresponding to the antenna element 102. Accordingly, the communication circuit 106C is also compatible with spatial multiplex communication, in which each of the antenna elements 102 transmits and receives a different wireless signal.

The communication circuit 106C mounted in the wireless communication device 100 is not limited to those illustrated in FIG. 3A and FIG. 3B. For example, the communication circuit 106C may only include the wireless circuit (RF), and the baseband circuit (BB) may be provided outside the wireless communication device 100. Alternatively, a different configuration may be adopted as the communication circuit 106C. The communication circuit 106C generates heat upon performing the transmission or reception of the wireless signal irrespective of the configuration, and hence the working of the circuit may be affected by the heat.

Figure 4:
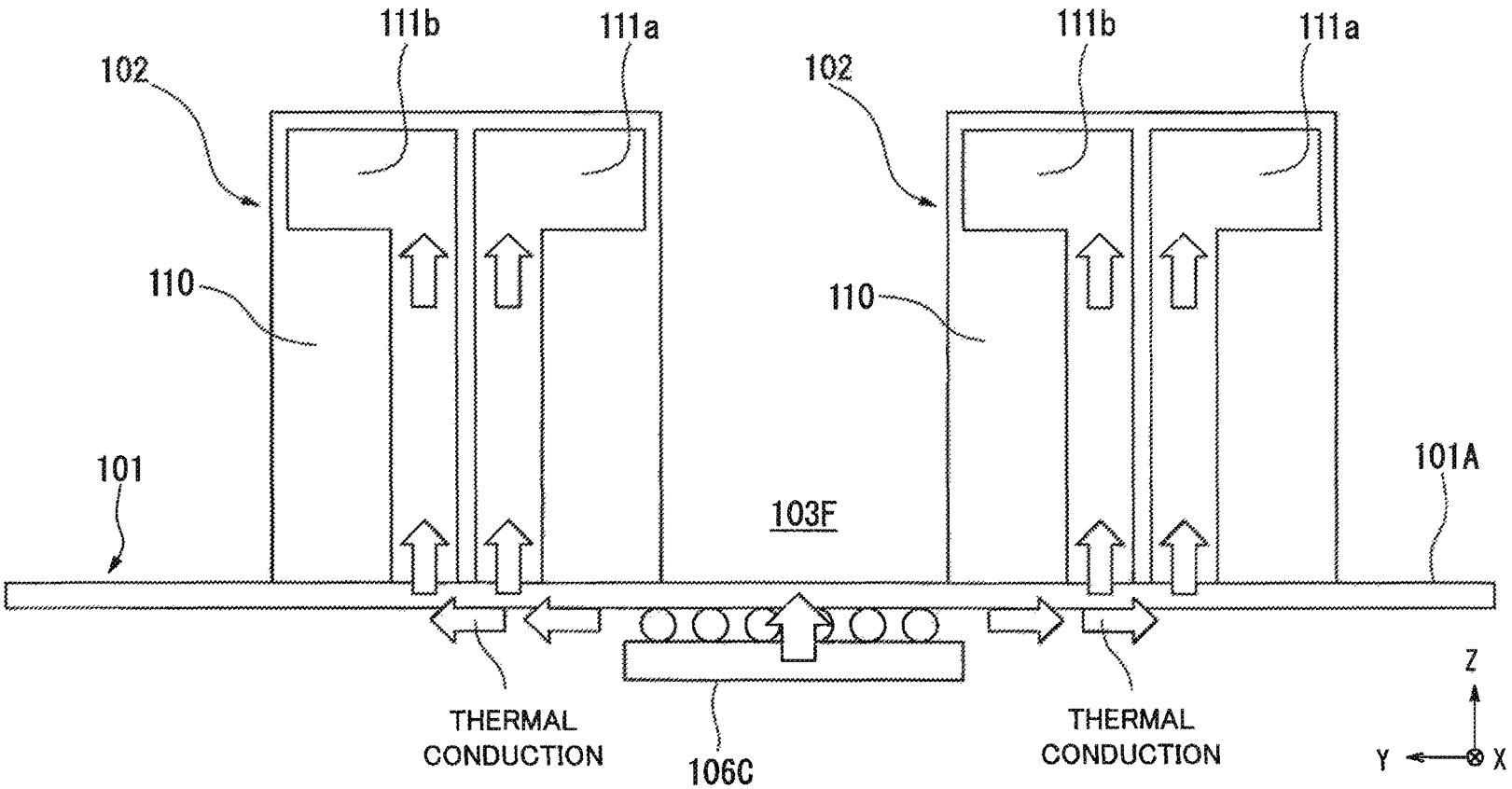
FIG. 4 is an enlarged side view for explaining how heat from a communication circuit in the wireless communication device according to the example 1 is dissipated.

Accordingly, the wireless communication device 100 according to the example 1 is configured to dissipate the heat, with a structure shown in FIG. 4. In the wireless communication device 100, the heat generated in the communication circuit 106C is conducted to the antenna element 102 through the reflecting plate 101, and then transferred to the ambient air from the upper end of each of the antenna element 102, thus to be dissipated to outside. In addition, outside air is introduced into the airflow path 103F formed inside the radome 103, to facilitate the heat release from the antenna elements 102. Thus, the outside air introduced through the air inlet 104 into the airflow path 103F makes contact with the surface of the antenna element 102, thereby removing the heat. In other words, the antenna elements 102 formed on the reflecting surface 101A of the reflecting plate 101 each act as a radiator fin. The air that has absorbed the heat from the antenna element 102 in the airflow path 103F is emitted to outside through the air outlet 105.

In particular, the air with an increased temperature because of the heat removal from the antenna element 102 gains a force directed to the vertically upper side, owing to the decreased density. Such a force creates natural convection of the air from the vertically lower side toward the vertically upper side, inside the airflow path 103F. In the example 1, the air inlet 104 and the air outlet 105 are formed in the lower and upper ends in the vertical direction (y-axis direction). To be more detailed, the air inlet 104 is formed on the vertically lower side of the airflow path 103F, and the air outlet 105 is formed on the vertically upper side of the airflow path 103F. In other words, the air inlet 104 and the air outlet 105 are opposed to each other, at the respective ends of the airflow path 103F in the vertical direction.

The outside air introduced into the airflow path 103F through the air inlet 104 smoothly flows toward the air outlet 105 formed on the vertically upper side of the airflow path 103F. At the same time, fresh outside air is continuously introduced through the air inlet 104, into the airflow path 103F. Thus, continuous natural convection, promoted by what is known as chimney effect, is formed from the air inlet 104 toward the air outlet 105. Therefore, the communication circuit 106C can continue to be efficiently cooled, during the continuous use of the wireless communication device 100.

In the wireless communication device 100, the antenna elements 102 are formed in a plate shape, and located such that the both surfaces in the thickness direction are respectively oriented to the positive side and the negative side in the x-axis direction. In other words, the projected area of the antenna elements 102 is sufficiently small, from the viewpoint of the air flowing in the y-axis direction in the airflow path 103F. Such a configuration minimizes the likelihood that the antenna elements 102 disturb the flow of the air inside the airflow path 103F.

Figure 5:
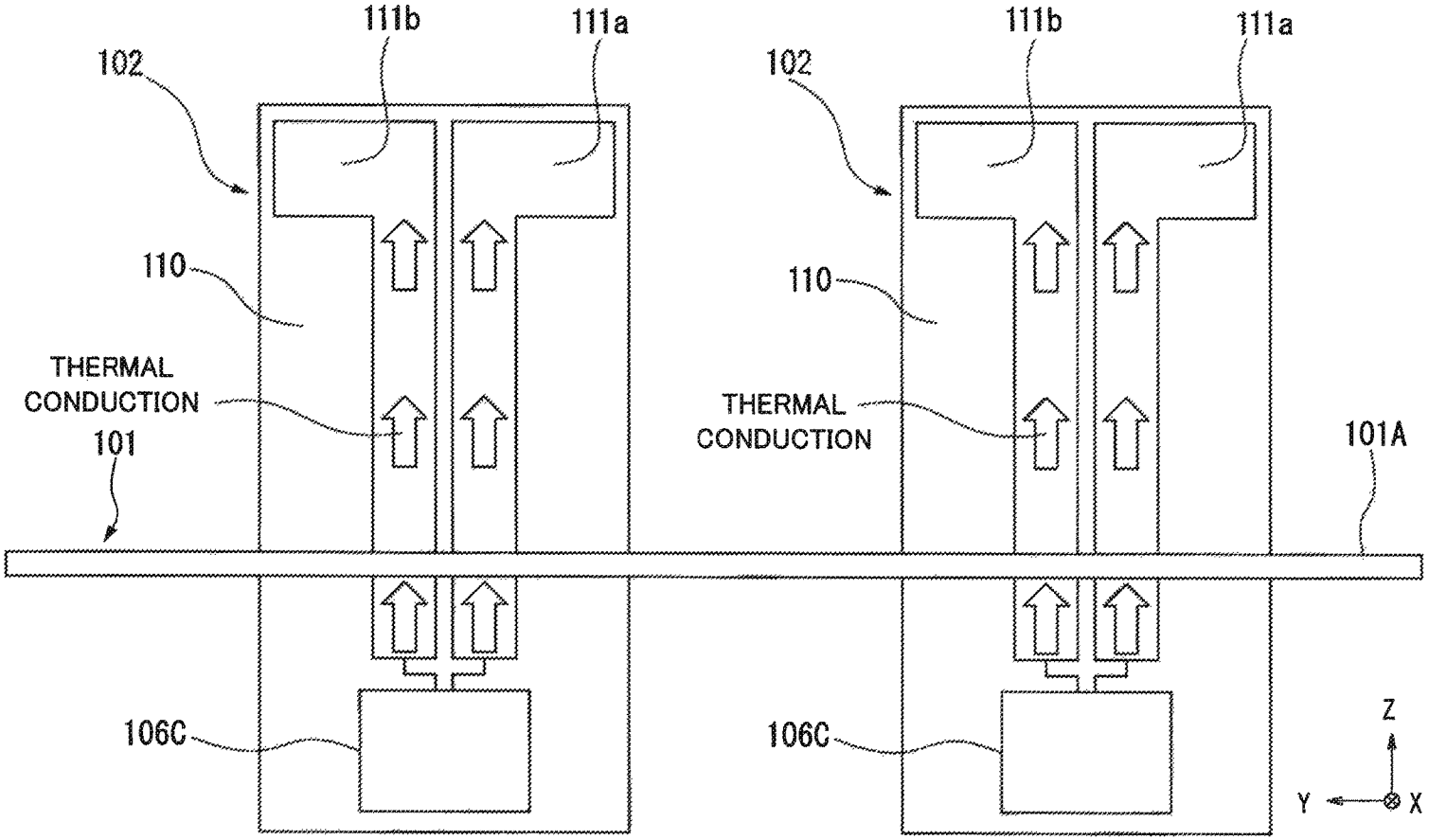
FIG. 5 is an enlarged side view showing a wireless communication device according to a first variation of the example 1.

Although the wireless communication device 100 according to the example 1 of the present invention has been described as above with reference to FIG. 1 to FIG. 4, the present invention is not limited to the mentioned configuration, but various modifications may be made. FIG. 5 is an enlarged side view showing the wireless communication device 100 according to a first variation of the example 1. As shown in FIG. 5, the antenna element 102 may penetrate through the reflecting plate 101 and extend to the opposite side of the reflecting surface 101A, and the communication circuit 106C may be located in the extended portion of the antenna element 102. Such a configuration reduces the thermal resistance between the communication circuit 106C and the antenna element 102, thereby facilitating the heat from the communication circuit 106C to be efficiently cooled.

Figure 6:
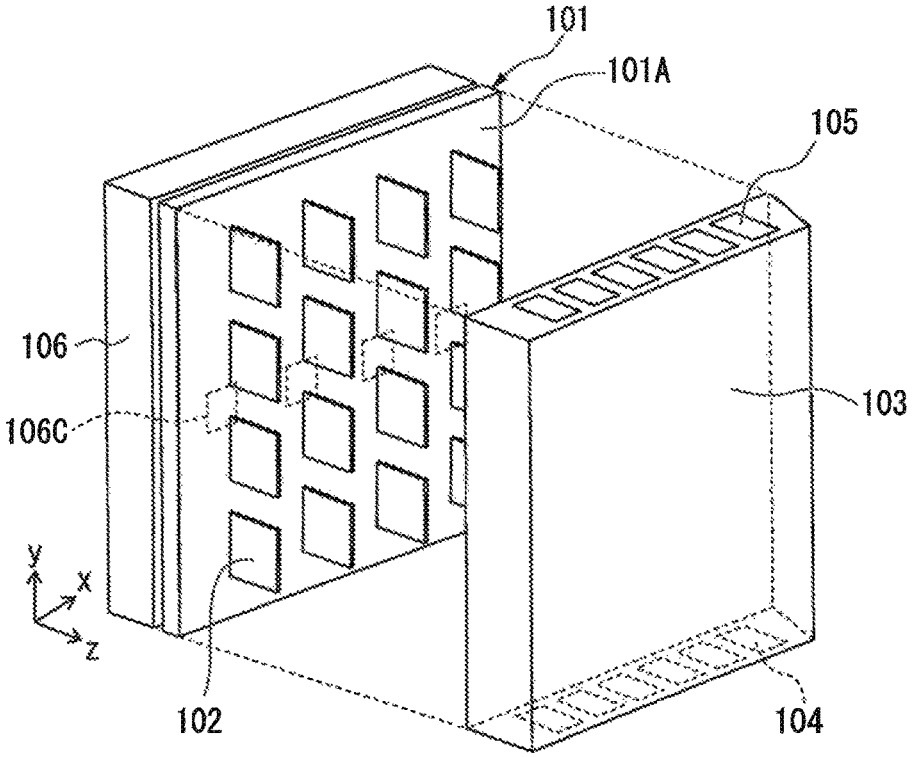
FIG. 6 is a perspective view showing a wireless communication device according to a second variation of the example 1.

FIG. 6 is a perspective view showing the wireless communication device 100 according to a second variation of the example 1. In the wireless communication device 100 shown in FIG. 1, the air inlet 104 and the air outlet 105 are formed by removing the entire area on the vertically upper side and the vertically lower side of the radome 103. Instead, as shown in FIG. 6, only a part of the vertically upper side and the vertically lower side of the radome 103 may be opened, to form the air inlet 104 and the air outlet 105. More specifically, the air inlet 104 may be constituted of a plurality of openings formed in the vertically lower side of the radome 103, and the air outlet 105 may be constituted of a plurality of openings formed in the vertically upper side of the radome 103.

Alternatively, one or more holes may be formed at desired positions of the radome 103, in addition to the air inlet 104 and the air outlet 105. In this case also, a larger amount of air can be introduced into the airflow path 103F, without affecting the natural convection from the air inlet 104 toward the air outlet 105. Therefore, the cooling performance of the wireless communication device 100 can be improved.

Figure 7:
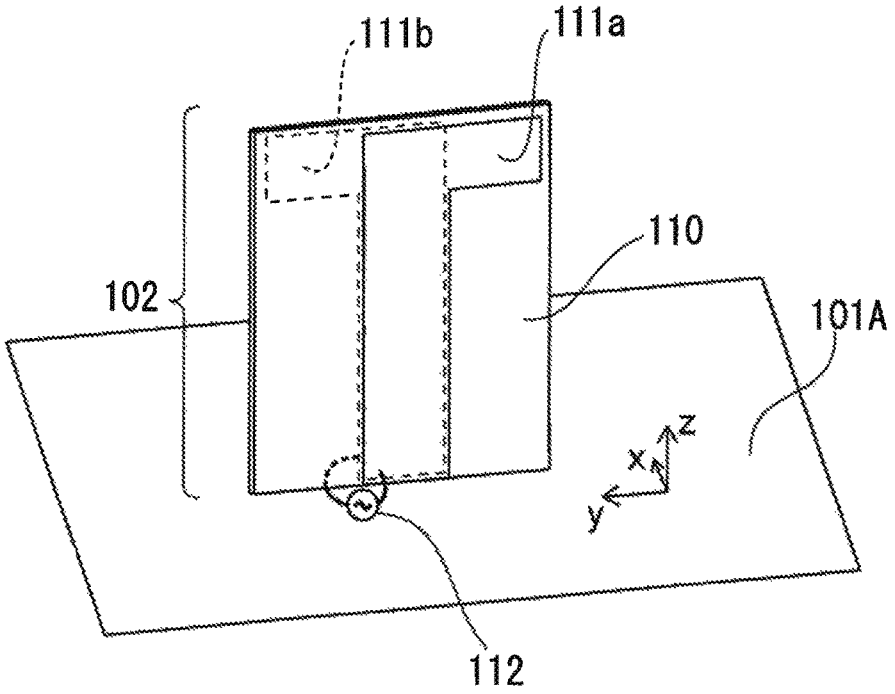
FIG. 7 is a perspective view showing a first variation of the antenna element.
Figure 8:
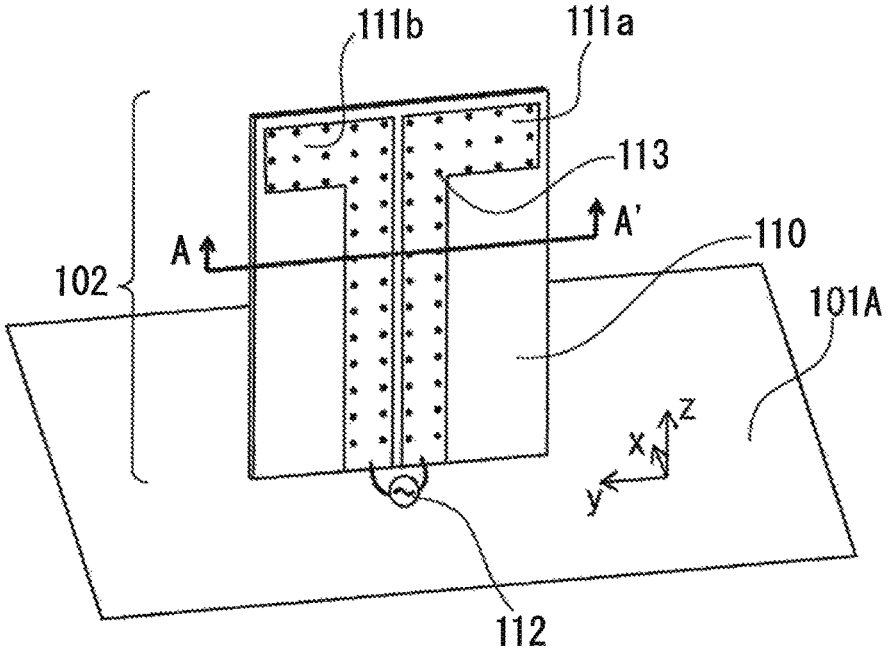
FIG. 8 is a perspective view showing a second variation of the antenna element.
Figure 9:
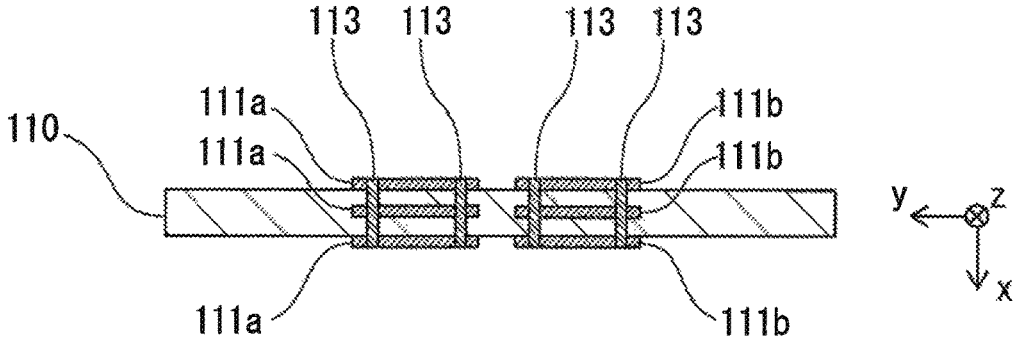
FIG. 9 is a cross-sectional view taken along a line A-A in FIG. 8.

Although the antenna elements 102 shown in FIG. 2 each include the pair of antenna patterns 111*a*, 111*b* only on one of the surfaces, a different configuration may be adopted. FIG. 7 is a perspective view showing a first variation of the antenna element 102. FIG. 8 is a perspective view showing a second variation of the antenna element 102. FIG. 9 is a cross-sectional view taken along a line A-A in FIG. 8. In the first variation shown in FIG. 7, the antenna pattern 111*a* is provided on one of the surfaces of the dielectric substrate 110, and the antenna pattern 111*b* is provided on the other surface. Although the antenna patterns 111*a* and 111*b* are both L-shaped, they are alternately arranged as shown in FIG. 7.

In the second variation shown in FIG. 8 and FIG. 9, the antenna patterns 111*a*, 111*b* are formed in each of a plurality of layers in the dielectric substrate 110. The plurality of antenna patterns 111*a* are connected to each other through a plurality of conductive vias 113, and the plurality of antenna patterns 111*b* are connected to each other through a plurality of conductive vias 113. Such a configuration allows the heat to propagate through the conductive vias 113, between the antenna patterns 111*a*, 111*b* formed in the plurality of layers in the dielectric substrate 110. Therefore, the thermal conductivity of the antenna element 102 as a whole is increased, which leads to improved heat dissipation performance of the wireless communication device 100.

Normally, the conductive via 113 is formed by plating the inner surface of a through hole formed in the dielectric substrate 110, however a different method may be adopted. Any desired process may be adopted, provided that the plurality of layers in the dielectric substrate 110 can be electrically or thermally connected. As specific examples, a laser via may be formed by irradiating the dielectric substrate 110 with a laser beam, or a conductive material such as copper may be inserted in the through hole formed in the dielectric substrate 110.

Figure 10:
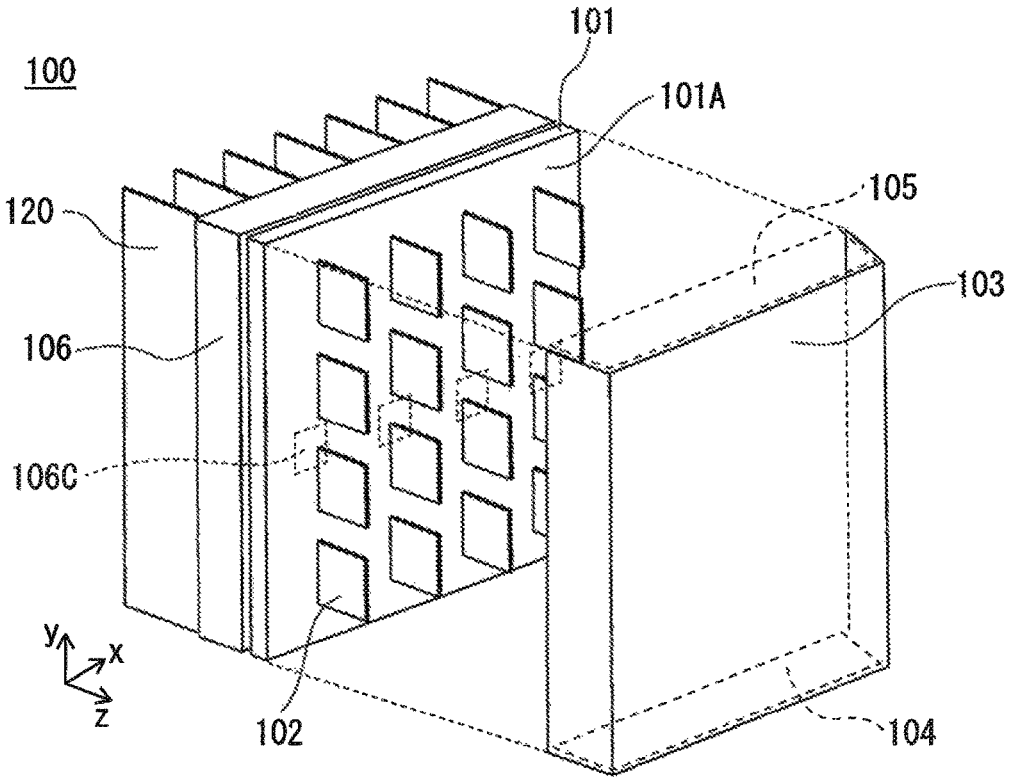
FIG. 10 is a perspective view showing a wireless communication device according to a third variation of the example 1.

FIG. 10 is a perspective view showing the wireless communication device 100 according to a third variation of the example 1. The wireless communication device 100 may include a radiator (heatsink) 120 located on the rear face of the casing 106 (i.e., surface of the reflecting plate 101 opposite to the reflecting surface 101A), as long as the installation environment permits. With such a configuration, the heat dissipation effect of the radiator 120 can be attained, in addition to the heat dissipation effect provided by the airflow path 103F in the radome 103, and therefore the heat dissipation performance of the wireless communication device 100 can be further improved.

Figure 11:
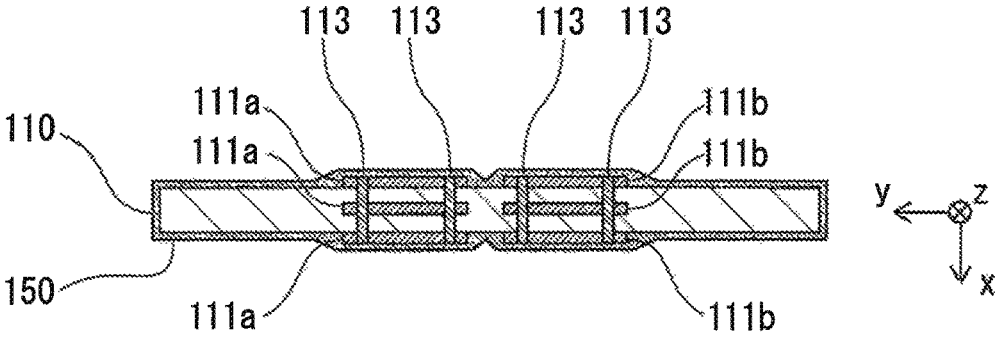
FIG. 11 is a cross-sectional view showing a third variation of the antenna element.

FIG. 11 is a cross-sectional view showing the third variation of the antenna element 102, corresponding to the cross-sectional view of FIG. 9. In FIG. 9, the plurality of antenna patterns 111*a*, 111*b* are respectively formed in the plurality of layers in the dielectric substrate 110, and the antenna patterns 111*a*, 111*b* are connected to each other via the plurality of conductive vias 113. In FIG. 11, a non-conductive protection film 150 covers the surface of the antenna element 102. Such a configuration protects the antenna patterns 111*a*, 111*b* from foreign matters that intrude into the radome 103, such as rain, snow, and dust, thereby improving the weather resistance of the wireless communication device 100. It is preferable to employ a water-repellent or water-resistant material, to form the protection film 150. In addition, the protection film 150 may be formed of an oil-resistant or heat-resistant material, if need be.

Figure 12:
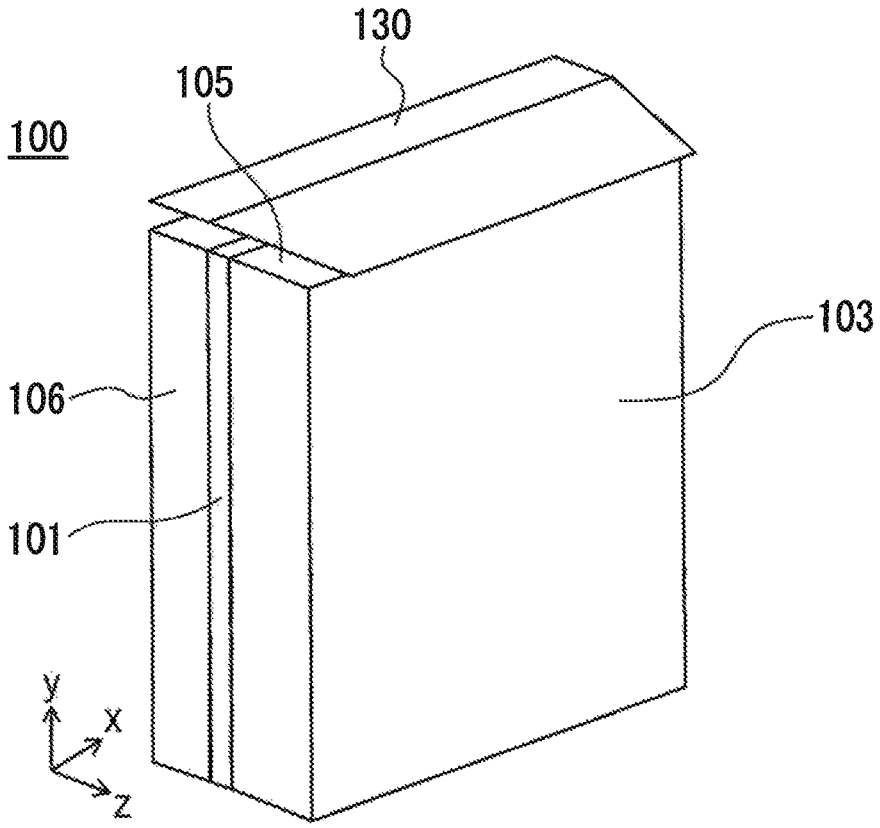
FIG. 12 is a perspective view showing a wireless communication device according to a fourth variation of the example 1.

FIG. 12 is a perspective view showing the wireless communication device 100 according to a fourth variation of the example 1. The wireless communication device 100 may include eaves 130 provided above the air outlet 105, depending on the installation environment. Such a configuration prevents intrusion of foreign matters such as rain and snow into the radome 103, to thereby improve the weather resistance of the wireless communication device 100. Further, the wireless communication device 100 may include a breathable member covering the air inlet 104 and the air outlet 105. Examples of the breathable member include a mesh material such as a wire gauze, and a cloth. Such a configuration prevents intrusion of foreign matters such as rain and snow into the radome 103, to thereby improve the durability and weather resistance of the wireless communication device 100.

Example 2

Figure 13A:
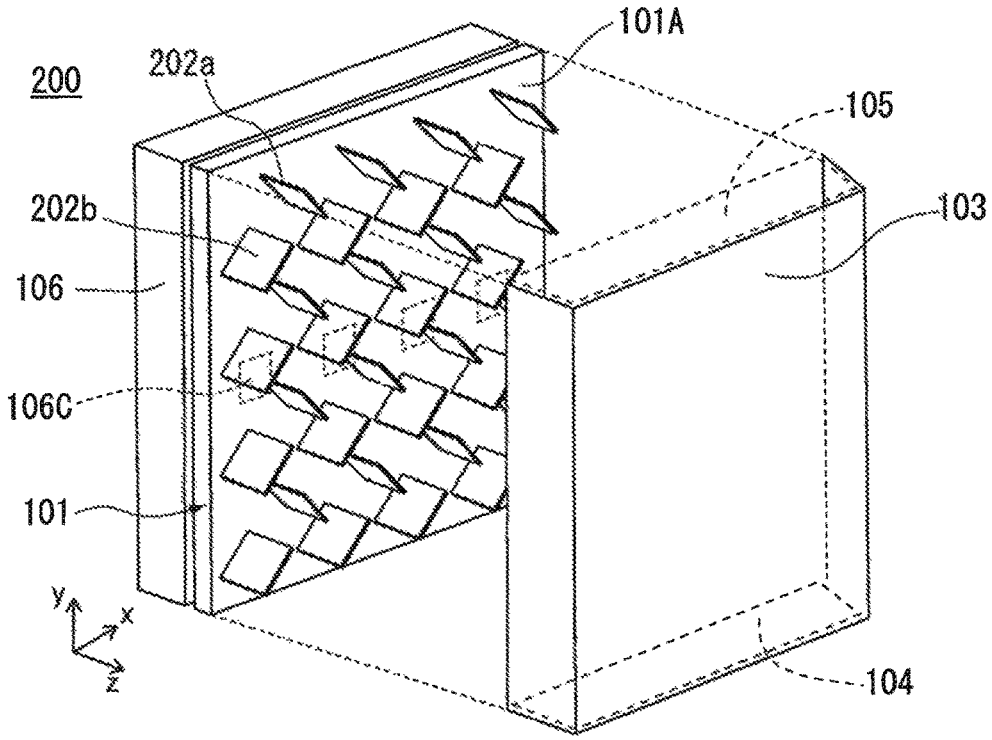
FIG. 13A is a perspective view showing a wireless communication device according to an example 2 of the present invention.
Figure 13B:
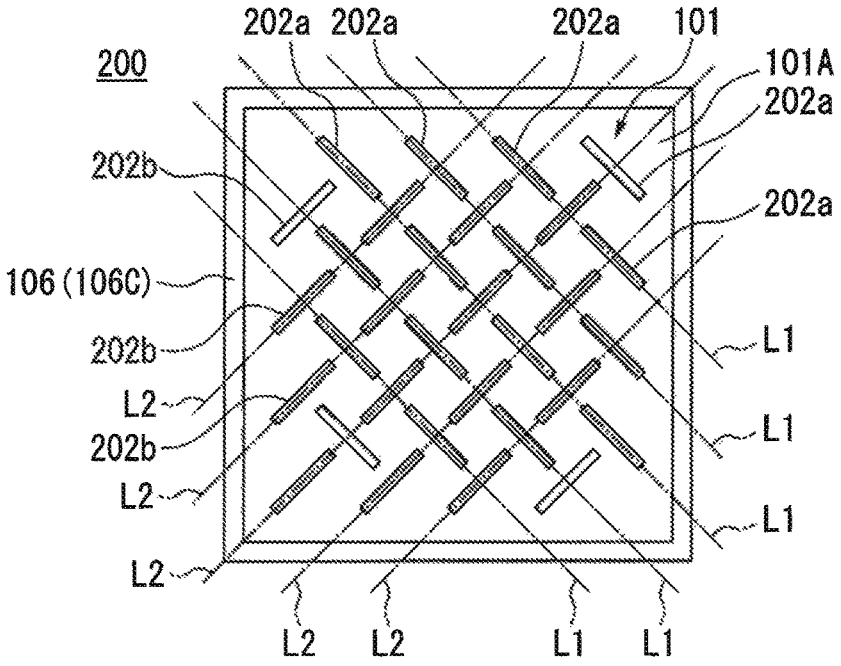
FIG. 13B is a plan view showing the wireless communication device according to the example 2 of the present invention.

Hereunder, a wireless communication device 200 according to an example 2 of the present invention will be described. FIG. 13A is a perspective view showing the wireless communication device 200, and FIG. 13B is a plan view showing the wireless communication device 200. In FIG. 13A and FIG. 13B, the same elements as those of the wireless communication device 100 according to the example 1 (FIG. 1) are given the same numeral, and the description thereof will not be repeated. The wireless communication device 200 includes the reflecting plate 101, the radome 103, the casing 106, and the communication circuit 106C. While the wireless communication device 100 includes the array antenna 102R including the plurality of antenna elements 102, and mounted on the reflecting surface 101A, the wireless communication device 200 includes a first element group L1 including a plurality of first antenna elements 202*a*, and a second element group L2 including a plurality of second antenna elements 202*b*. Hereafter, the first and second antenna elements 202*a*, 202*b* may be collectively referred to as antenna elements 202.

In the first element group L1, a plurality of the first antenna elements 202*a* are aligned in a first direction in the reflecting surface 101A. More specifically, the first antenna elements 202*a* are aligned in the first direction inclined by approximately 45 degrees with respect to the y-axis direction (vertical direction), in the yz-plane on the reflecting surface 101A (xy-plane). In the second element group L2, a plurality of the second antenna elements 202*b* are aligned in a second direction generally orthogonal to the first direction, in the yz-plane. In addition, the first antenna elements 202*a* are aligned with an interval from each other, in the first direction, and the second antenna element 202*b* are aligned with an interval from each other, in the second direction. Thus, a plurality of the first element groups L1 are aligned in the second direction with an interval from each other, on the reflecting surface 101A, and a plurality of the second element groups L2 are aligned in the first direction with an interval from each other, on the reflecting surface 101A.

The plurality of first antenna elements 202*a* and the plurality of second antenna elements 202*b* are arranged in a square grid pattern, the grids having the same grid constant. Therefore, the intervals between the first antenna elements 202*a* adjacent to each other are generally the same, when viewed in the normal direction of the reflecting surface 101A (xy-plane), in other words in the z-direction. Likewise, the intervals between the second antenna elements 202*b* adjacent to each other are generally the same, when viewed in the normal direction of the reflecting surface 101A.

The first antenna element 202*a* is located between the second antenna elements 202*b* adjacent to each other in the second direction. In addition, when viewed in the normal direction of the reflecting surface 101A, the line connecting the second antenna elements 202*b* adjacent to each other passes a center between the first antenna elements 202*a* aligned in the first direction. Since the second antenna elements 202*b* are also arranged so as to form the square grid as mentioned above, the line connecting the first antenna elements 202*a* adjacent to each other also passes a center between the second antenna elements 202*b* aligned in the second direction. Here, the term "center" does not have to represent the midpoint between the first antenna elements 202*a* adjacent to each other, or the midpoint between the second antenna elements 202*b* adjacent to each other. In other words, it suffices that the "center" falls in a region including a line segment that substantially equally divides the section between the first antenna elements 202*a*, or a region including a line segment that substantially equally divides the section between the second antenna elements 202*b*.

The first element group L1 and the second element group L2 are arranged orthogonal to each other, and hence the respective polarized waves are also orthogonal to each other. In addition, the transmission and reception status of the first element group L1 and the second element group L2 is individually controlled by the communication circuit 106C. Accordingly, the wireless signals different in phase and power are supplied to each of the first element group L1 and the second element group L2, from the communication circuit 106C. Thus, the first element group L1 and the second element group L2 form array antennas 202R that are independent from each other. The array antennas 202R act as a dual polarized array antenna capable of forming different beams from each of the polarized wave.

The wireless communication device 200, in which the first element group L1 and the second element group L2 are arranged as above on the reflecting surface 101A, minimizes the likelihood that regions with high intensity in the electric field and the magnetic field, formed by signal emission from the first antenna element 202*a* and the second antenna element 202*b*, overlap each other. Therefore, the first antenna elements 202*a* and the second antenna elements 202*b* can be located close to each other, with minimized risk of electromagnetic coupling between each other.

In the foregoing configuration, further, the gaps between the first antenna element 202*a* and the second antenna element 202*b* meander in a zigzag pattern in the y-axis direction. Accordingly, the air flowing through the airflow path 103F formed in the radome 103, because of the natural convection, makes sufficient contacts with the first antenna element 202*a* and the second antenna element 202*b*, and therefore the heat dissipation performance of the wireless communication device 200 can be improved.

Although the example 2 of the present invention has been described as above with reference to FIG. 13A and FIG. 13B, various modifications may be made within the scope of the present invention. Although both of the first antenna elements 202*a* and the second antenna elements 202*b* are arranged in the square grid pattern in the example 2, a different arrangement may be adopted. For example, at least one of the first antenna elements 202*a* and the second antenna elements 202*b* may be arranged in a rectangular grid pattern.

Figure 14:
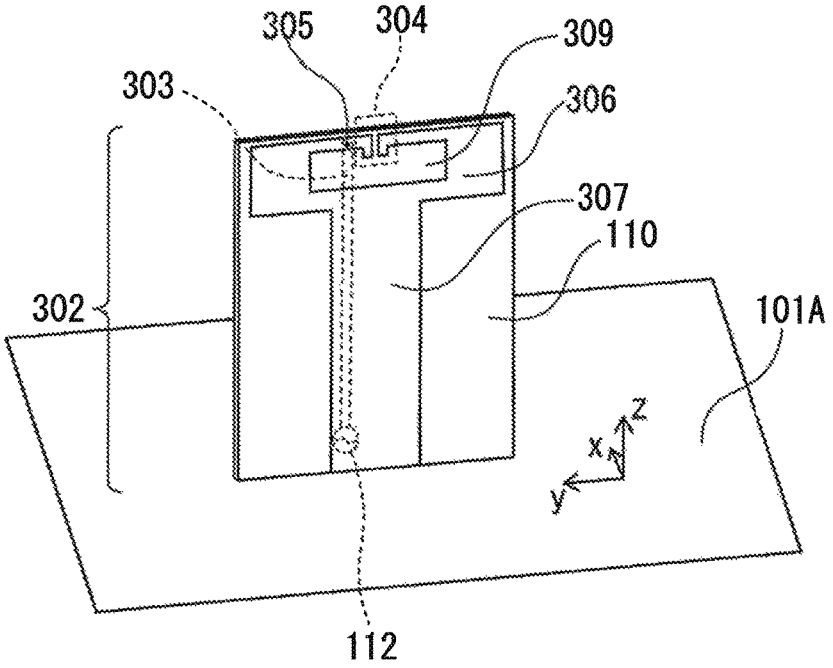
FIG. 14 is a perspective view showing a fourth variation of the antenna element.
Figure 15:
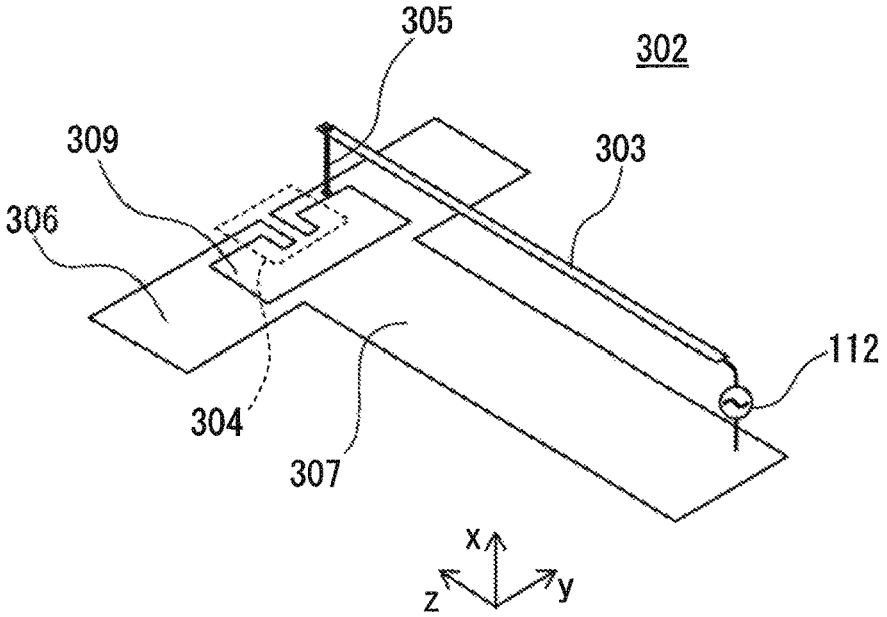
FIG. 15 is a perspective view showing a printed circuit section constituting the fourth variation of the antenna element.

In the above examples, the antenna elements 102 and the antenna elements 202 (first and second antenna elements 202*a*, 202*b*) are each configured as a dipole antenna, however a different configuration may be adopted. As shown in FIG. 14 and FIG. 15, an antenna element 302 configured as a split ring resonator may be adopted. FIG. 14 is a perspective view showing the antenna element 302, and FIG. 15 is a perspective view showing a printed circuit section constituting the antenna element 302.

The antenna element 302 includes a generally T-shaped printed circuit formed on the surface of the dielectric substrate 110. A generally rectangular region of the printed circuit, on the side of the reflecting surface 101A of the reflecting plate 101, is denoted as a rectangular conductor 307. In contrast, the generally C-shaped region on the upper side of the rectangular conductor 307 is denoted as an annular conductor 306. A conductor feeder 303 is provided with a spacing from the T-shaped printed circuit in the x-axis direction. An end of the conductor feeder 303 is connected to a lower end portion of the rectangular conductor 307 through the feed point 112, and the other end is connected to an upper end portion of the annular conductor 306 through a B conductive via 305.

The annular conductor 306 includes a split portion 304, formed by cutting away a part of the annular conductor 306 in the circumferential direction. Thus, a rectangular region 309 is defined inside the annular conductor 306, and the rectangular region 309 generates a magnetic field. In addition, the slit (split) portion 304 serves as a capacitor to secure a certain electrostatic capacitance.

The antenna element 302 acting as the split ring resonator can be formed in a smaller size than a dipole antenna of the same operation frequency. In the case of adopting the antenna element 302 as the antenna element 202 in the wireless communication device 200, the gaps defined by the antenna elements 202 can be made larger, compared with the wireless communication device 100 including the antenna element 102 configured as a dipole antenna. Therefore, an array antenna structure that does not disturb the airflow in the airflow path 103F can be attained. Such a structure efficiently cools the heat generated in the communication circuit 106C.

Figure 16:
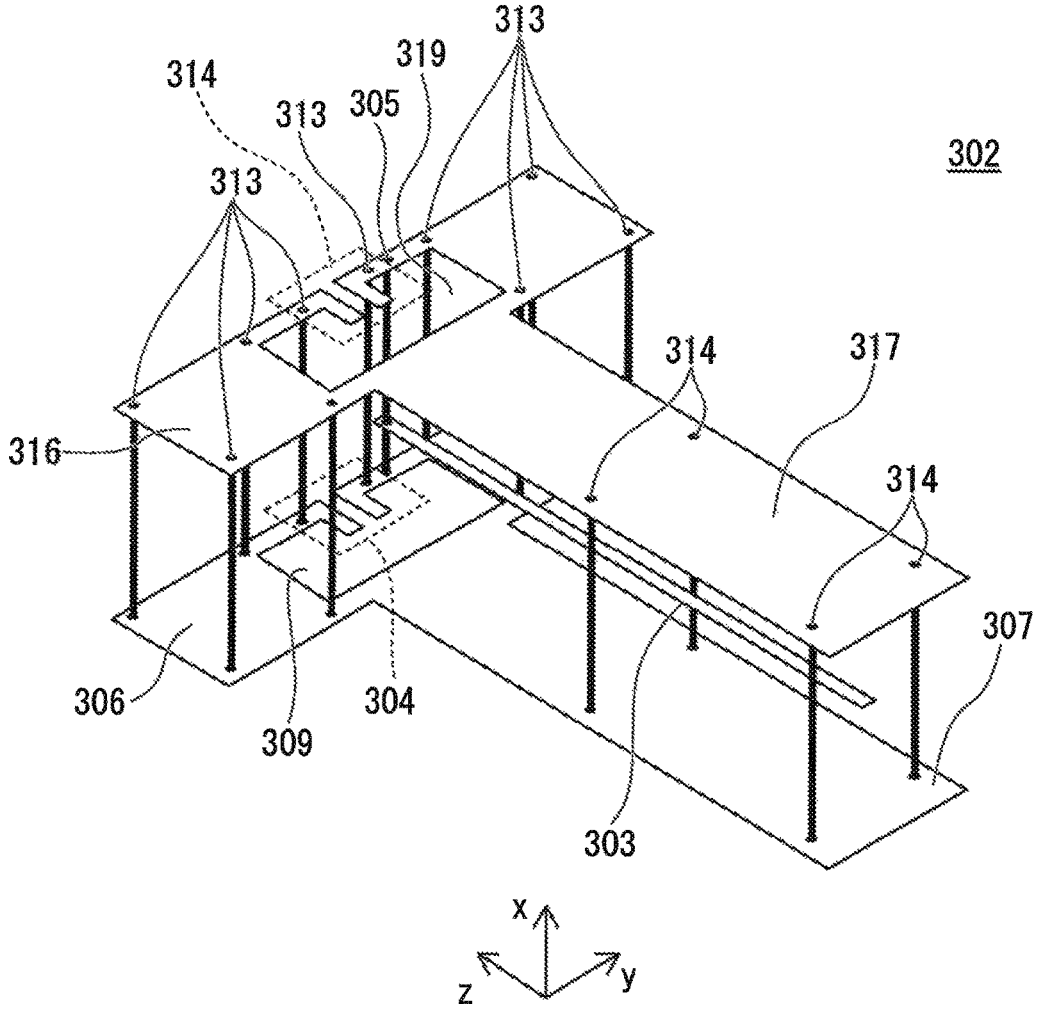
FIG. 16 is a perspective view showing a fifth variation of the antenna element.

FIG. 16 is a perspective view showing a variation of the antenna element 302. In this variation, a plurality of the T-shaped structures acting as the split ring resonator are stacked in the x-axis direction. More specifically, the structures each composed of an annular conductor 316 including a split portion 314 and a rectangular region 319, and a rectangular conductor 317, like the structure composed of the annular conductor 306 including the split portion 304 and the rectangular region 309, and the rectangular conductor 307, are spaced from each other in the x-axis direction, and connected to each other through vias 313, 314. In addition, a conductor feeder 303 is provided between the structures, and is connected through the B conductive via 305. Such a configuration improves the shield performance with respect to the conductor feeder 303, with the structures opposed to each other (each corresponding to the antenna element 302 shown in FIG. 14). In other words, the conductor feeder 303 can be protected from a noise from outside. Here, the antenna element 302 shown in FIG. 14 to FIG. 16 may also be applied to the wireless communication device 100.

Although the foregoing examples are configured to facilitate the heat dissipation from the antenna element 102 and the antenna element 202, utilizing the natural convection of the air that takes place in the airflow path 103F in the radome 103, a different arrangement may be adopted. The air convection may be forcibly generated in the airflow path 103F, instead of depending on the natural convection.

Figure 17:
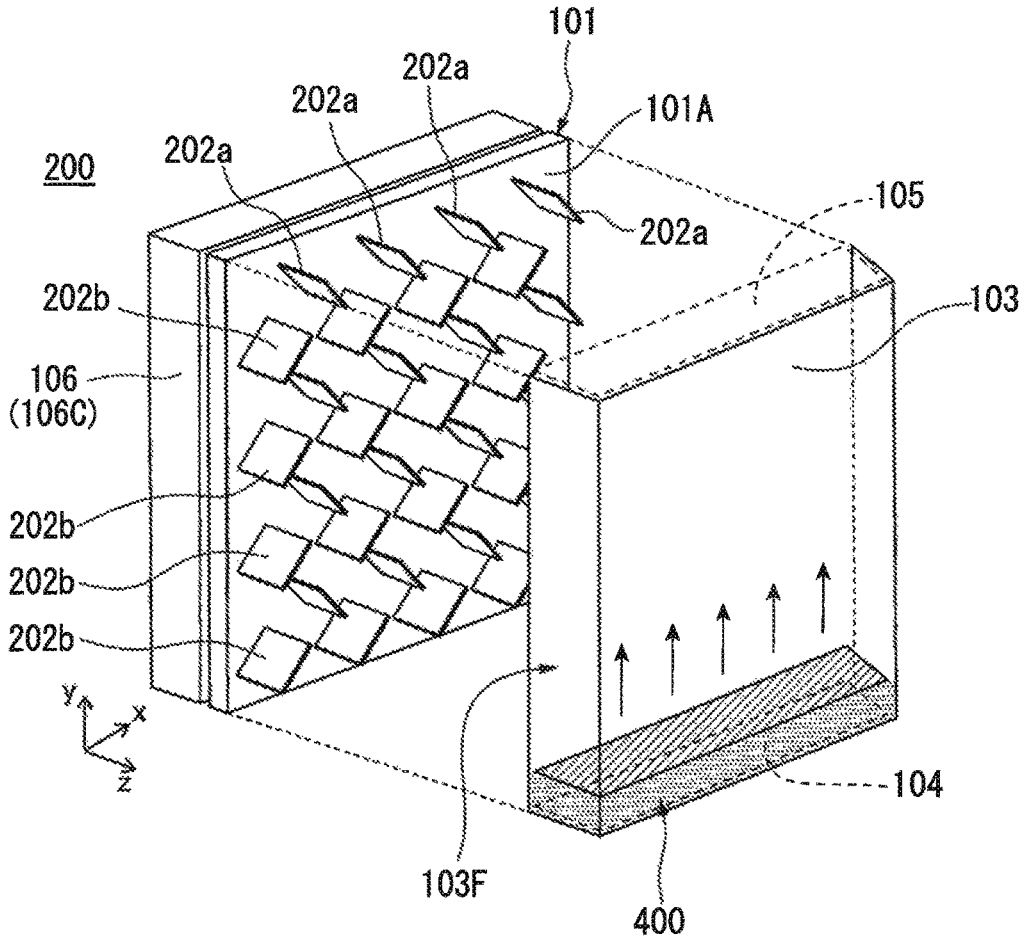
FIG. 17 is a perspective view showing a wireless communication device according to a variation of the example 2.

FIG. 17 is a perspective view showing the wireless communication device 200 according to a variation of the example 2. In this variation, a fan 140 is provided at the air inlet 104 of the airflow path 103F. The fan 140 is driven to rotate by power supplied from outside, so as to forcibly introduce the air from outside into the airflow path 103F. Thus, forced air convection is generated inside the airflow path 103F.

In this case, efficient and sufficient heat dissipation effect can be attained, compared with the heat dissipation that depends solely on the natural convection of the air. Although the fan 140 is provided at the air inlet 104 of the airflow path 103F, the fan 140 may be located at a different position, provided that the forced air convection can be generated in the airflow path 103F. For example, providing the fan 140 at the air outlet 105 of the airflow path 103F also provides the same heat dissipation effect. Here, the fan 140 may also be applied to the wireless communication device 100.

Example 3

Figure 18:
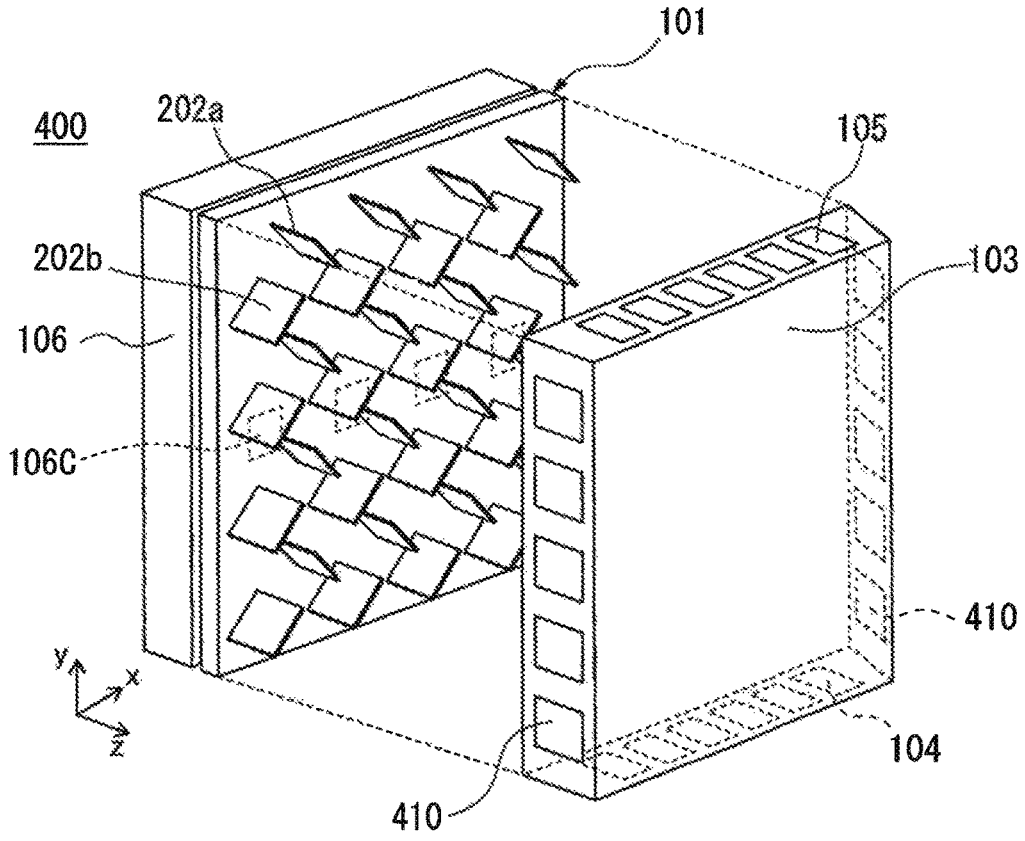
FIG. 18 is a perspective view showing a wireless communication device according to an example 3 of the present invention.

Hereunder, a wireless communication device 400 according to an example 3 of the present invention will be described. FIG. 18 is a perspective view showing the wireless communication device 400 according to the example 3 of the present invention. In the wireless communication device 400 according to the example 3, the same elements as those of the wireless communication device 100 according to the example 1, and the wireless communication device 200 according to the example 2, are given the same numeral, and the description thereof will not be repeated. The wireless communication device 400 includes the reflecting plate 101, the radome 103, and the casing 106. In addition, the antenna elements 202 (i.e., first antenna elements 202*a* and second antenna elements 202*b*) are provided on the reflecting surface 101A of the reflecting plate 101.

The wireless communication device 400 according to the example 3 includes, unlike the wireless communication device 100 according to the example 1 and the wireless communication device 200 according to the example 2, a plurality of lateral vent holes 410, each of which is an opening formed in both side faces of the radome 103 in the x-axis direction, in addition to the air inlet 104 and air outlet 105 each including a plurality of openings. The lateral vent holes 410 are each formed such that the opening is oriented in the horizontal direction (x-axis direction), intersecting the vertical direction (y-axis direction) from the air inlet 104 toward the air outlet 105.

Forming the lateral vent holes 410 facilitates outdoor wind blowing in the horizontal direction to be efficiently introduced into the radome 103, in addition to the natural convection originating from the temperature increase of the air around the wireless communication device 400. Accordingly, the heat dissipation effect of the wireless communication device 400 can be further improved. Even when the wind is unavailable in the region around the wireless communication device 400, additional air intake can be attained through the lateral vent holes 410 into the radome 103, and therefore sufficient heat dissipation performance can be secured.

Figure 19:
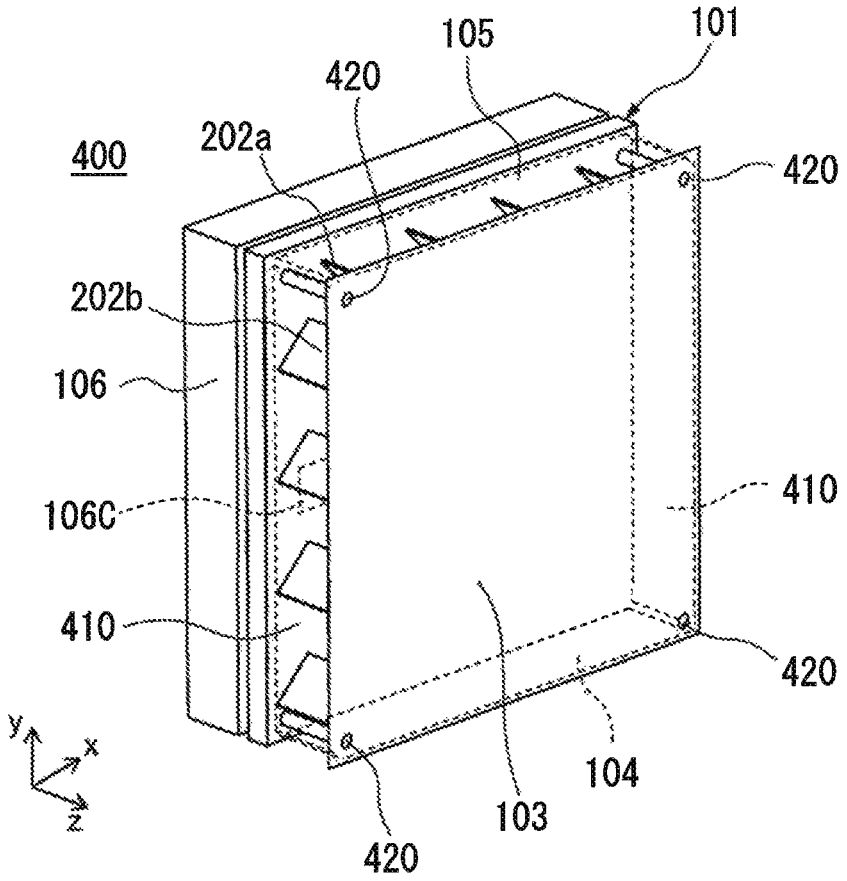
FIG. 19 is a perspective view showing a wireless communication device according to a first variation of the example 3.

FIG. 19 is a perspective view showing the wireless communication device 400 according to a first variation of the example 4. In the first variation, the lateral vent hole 410 is formed by opening the entire side face of the radome 103 in the x-axis direction, on both sides. In this case, the radome 103 is fixed to the reflecting plate 101 with a support member 420 provided at each of the four corners. Such a configuration maximizes the opening area of the lateral vent hole 410, thereby further improving the heat dissipation performance. Here it is preferable to employ a non-conductive material to form the support member 420, so as not to interrupt the emission of the radio wave, from the first antenna element 202*a* and the second antenna element 202*b*.

Figure 20:
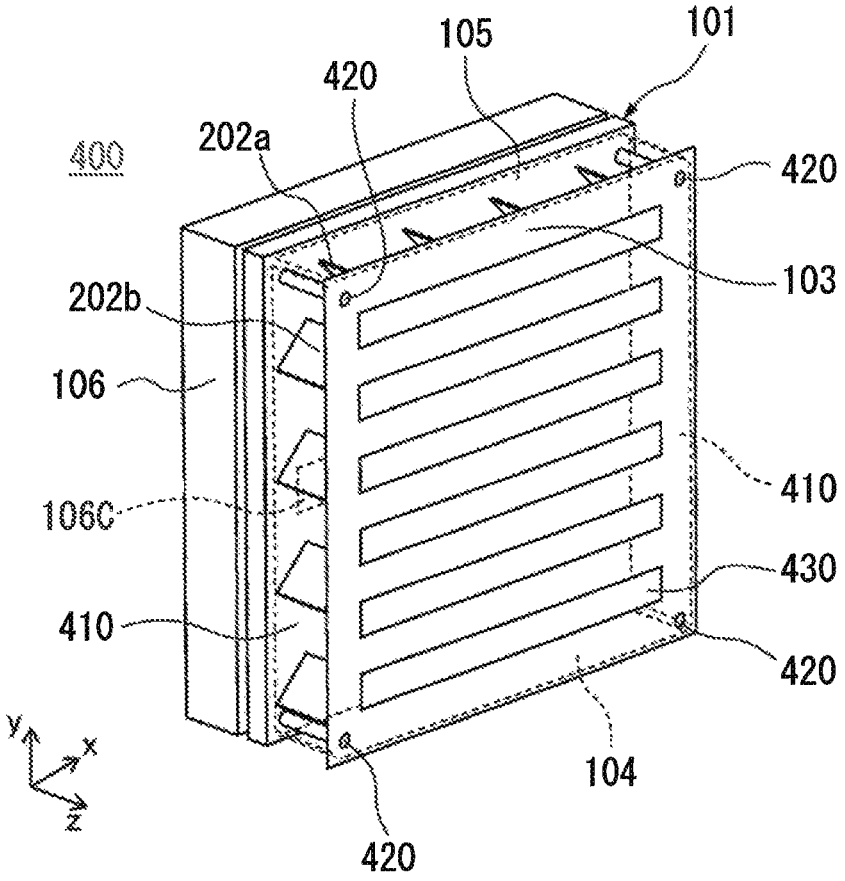
FIG. 20 is a perspective view showing a wireless communication device according to a second variation of the example 3.

FIG. 20 is a perspective view showing the wireless communication device 400 according to a second variation of the example 4. In the second variation, a plurality of front vent holes 430, each formed of an opening, are provided in the front face of the radome 103 in the z-axis direction. Such a configuration allows outdoor wind blowing from the z-axis direction to be efficiently introduced into the radome 103, thereby further improving the heat dissipation performance. Here, since the wireless communication device 400 is often installed outdoors, small animals, birds, insects, and foreign matters such as dust and pebbles, may collide with the radome 103. Accordingly, it is preferable to form the front vent hole 430 with an opening area that is sufficiently smaller than the small animals and foreign matters that are likely to collide with the radome 103, to prevent the first antenna elements 202*a* and the second antenna elements 202*b* from being damaged, owing to the collision of the small animal or foreign matter with the radome 103.

The present invention is not limited to the foregoing examples and variations, but encompasses design changes and modifications made within the scope of the present invention defined by the appended claims.

INDUSTRIAL APPLICABILITY

Although the present invention relates to the wireless communication device that transmits and receives wireless signals through a plurality of antennas, the present invention is also applicable to apparatuses that transmit and receive a radio wave, in addition to those used in base stations and mobile terminal devices.

REFERENCE SIGNS LIST

100, 200, 400 wireless communication device
101 reflecting plate
101A reflecting surface
102 antenna
102R array antenna
103 radome
103F airflow path
104 air inlet
105 air outlet
106 casing
106C communication circuit
110 dielectric substrate
111*a*, 111*b* antenna pattern
112 feed point
113 conductor (conductive) via
120 radiator
140 fan
202*a* first antenna element
202*b* second antenna element
302 antenna
303 conductor feeder
304 split portion
305 Bconductive via
306 annular conductor
307 rectangular conductor
309 rectangular region
410 lateral vent hole
420 support member
430 front vent hole
L1 first element group
L2 second element group

The invention claimed is:

1. A wireless communication device comprising:

a reflecting plate that has a reflecting surface that reflects electromagnetic waves;

a radome that covers the reflecting plate so as to form an airflow path between the radome and the reflecting surface, and includes an air inlet and an air outlet that communicate with the airflow path by having holes in the top and bottom of the radome;

an array antenna provided on the reflecting surface and inside the airflow path, and that includes a plurality of antenna elements aligned on the reflecting surface with an interval from each other; and a communication circuit that transmits and receives a wireless signal by exciting the array antenna, wherein the plurality of antenna elements each include an antenna pattern formed on a plate-shaped dielectric substrate extending from the reflecting surface in a direction orthogonal thereto, wherein a direction of thickness of the plurality of antenna elements is perpendicular to the direction of the airflow path and the direction in which the dielectric substrate extends.

2. The wireless communication device according to claim 1, wherein the communication circuit is provided on a surface of the reflecting plate opposite to the reflecting surface.

3. The wireless communication device according to claim 1, wherein the plurality of antenna elements each include an extended portion penetrating through the reflecting plate and sticking out in a direction opposite to the reflecting surface, and the communication circuit is connected to the extended portion.

4. The wireless communication device according to claim 1, wherein the plurality of antenna elements transmit and receive an electromagnetic wave polarized in a direction perpendicular to the reflecting plate.

5. The wireless communication device according to claim 1, wherein the plurality of antenna elements each include:

a first element group that includes a plurality of first antenna elements aligned with an interval from each other, in a first direction along the reflecting surface of the reflecting plate, and each of the plurality of first antenna elements being configured to transmit and receive an electromagnetic wave polarized in the first direction; and a second element group that include a plurality of second antenna elements aligned with an interval from each other, in a second direction along the reflecting surface of the reflecting plate and orthogonal to the first direction, and each of the plurality of second antenna elements being configured to transmit and receive an electromagnetic wave polarized in the second direction, wherein a plurality of the first element groups are provided with an interval from each other in the second direction, and a plurality of the second element groups are provided with an interval from each other in the first direction.

6. The wireless communication device according to claim 5, wherein the plurality of the first antenna elements are located between the plurality of second antenna elements adjacent to each other in the second direction, and a line connecting the adjacent second antenna elements passes through a center between the plurality of the first antenna elements aligned in the first direction, when viewed in a normal direction of the reflecting surface of the reflecting plate.

7. The wireless communication device according to claim 1, wherein the plurality of antenna elements each include:

a plurality of antenna patterns respectively formed in a plurality of layers included in the dielectric substrate: and a conductive via that connects the plurality of antenna patterns formed in different layers in the dielectric substrate.

8. The wireless communication device according to claim 1, wherein the air inlet and the air outlet formed in the radome are opposed to each other in a direction perpendicular to the reflecting plate.

9. The wireless communication device according to claim 1, wherein the radome includes a vent hole different from the air inlet and the air outlet, the vent hole being constituted of an opening formed in a direction intersecting a direction from the air inlet toward the air outlet.

10. The wireless communication device according to claim 1, further comprising a fan that forcibly supplies air into the radome.

* * * * *